US012181162B2

(12) United States Patent
Yaji et al.

(10) Patent No.: US 12,181,162 B2
(45) Date of Patent: Dec. 31, 2024

(54) COOLING STRUCTURE AND OUTDOOR UNIT INCLUDING COOLING STRUCTURE

(71) Applicant: MITSUBISHI ELECTRIC CORPORATION, Chiyoda-ku (JP)

(72) Inventors: Yoshikazu Yaji, Chiyoda-ku (JP); Shigetoshi Ipposhi, Chiyoda-ku (JP); Naoki Suetomi, Chiyoda-ku (JP); Ryuji Momose, Chiyoda-ku (JP); Keisuke Iwasawa, Chiyoda-ku (JP); Kentaro Yonehara, Chiyoda-ku (JP); Hayato Kurino, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 971 days.

(21) Appl. No.: 16/968,970

(22) PCT Filed: Mar. 19, 2018

(86) PCT No.: PCT/JP2018/010800
§ 371 (c)(1),
(2) Date: Aug. 11, 2020

(87) PCT Pub. No.: WO2019/180777
PCT Pub. Date: Sep. 26, 2019

(65) Prior Publication Data
US 2021/0055007 A1 Feb. 25, 2021

(51) Int. Cl.
*F24F 1/24* (2011.01)
*F24F 1/48* (2011.01)
(Continued)

(52) U.S. Cl.
CPC ..... *F24F 1/24* (2013.01); *F24F 1/48* (2013.01); *F24F 1/56* (2013.01); *F24F 11/88* (2018.01);
(Continued)

(58) Field of Classification Search
CPC ..... F24F 1/24; F24F 1/48; F24F 1/56; F24F 11/88; F24F 13/08; F24F 13/20; F24F 2013/205
See application file for complete search history.

(56) References Cited

U.S. PATENT DOCUMENTS

2018/0363928 A1 12/2018 Yamamoto et al.

FOREIGN PATENT DOCUMENTS

EP 1 684 022 A1 7/2006
JP 5-259325 A 10/1993
(Continued)

OTHER PUBLICATIONS

Kasugai et al. (JP2015048990A), English Translation, Outdoor Unit of Air Conditioner, Mar. 16, 2015, Whole Document (Year: 2015).*
(Continued)

*Primary Examiner* — Larry L Furdge
*Assistant Examiner* — Keith Stanley Myers
(74) *Attorney, Agent, or Firm* — XSENSUS LLP

(57) ABSTRACT

A cooling structure includes: a heat sink to be mounted to a heat generator; and a duct, which is mounted to the heat sink, and is configured to guide an air flow flowing around the heat sink to the heat sink, wherein the heat sink has an air flow passage configured to allow the air flow to pass through the air flow passage, wherein one end side of the duct is to be mounted to an upstream side of the air flow passage, and wherein another end side of the duct is to be extended from an upstream end portion of the air flow passage to an upstream side of the air flow.

15 Claims, 10 Drawing Sheets

(51) Int. Cl.

| | |
|---|---|
| ***F24F 1/56*** | (2011.01) |
| ***F24F 11/88*** | (2018.01) |
| ***F24F 13/08*** | (2006.01) |
| ***F24F 13/20*** | (2006.01) |

(52) U.S. Cl.
CPC ..... *F24F 13/08* (2013.01); *F24F 13/20* (2013.01); *F24F 2013/205* (2013.01)

(56) References Cited

FOREIGN PATENT DOCUMENTS

| | | | | |
|---|---|---|---|---|
| JP | 6-32932 | U | | 4/1994 |
| JP | 10-267325 | A | | 10/1998 |
| JP | 2001-99448 | A | | 4/2001 |
| JP | 2009-299907 | A | | 12/2009 |
| JP | 2011-149648 | A | | 8/2011 |
| JP | 2012-145287 | A | | 8/2012 |
| JP | 2014-102034 | A | | 6/2014 |
| JP | 2015048990 | A | * | 3/2015 |
| JP | 2016210263 | A | * | 12/2016 |
| WO | WO 2017/130273 | A | | 8/2017 |

OTHER PUBLICATIONS

Mikoshiba et al. (JP2016210263A), English Translation, 2016, Whole Document (Year: 2016).*
Indian Office Action issued May 31, 2021 in Indian Office Action 202027034157.
International Search Report issued May 29, 2018 in PCT/JP2018/010800 filed Mar. 19, 2018, citing documents AR-AV therein, 2 pages.

* cited by examiner

COOLING STRUCTURE AND OUTDOOR UNIT INCLUDING COOLING STRUCTURE

TECHNICAL FIELD

The present invention relates to a cooling structure for an electric circuit board and an outdoor unit for an air conditioner, which includes the cooling structure for an electric circuit board.

BACKGROUND ART

Hitherto, an outdoor unit for an air conditioner is partitioned into two chambers, specifically, a fan chamber in which an air-sending fan and a heat exchanger are arranged and a machine chamber in which a compressor and a refrigerant pipe are arranged. Further, an electric circuit board is mounted to the outdoor unit. The electric circuit board is arranged across the fan chamber and the machine chamber.

A power supply control component is mounted on the electric circuit board. The power supply control component is caused to generate heat. Therefore, a heat sink including a plurality of fins configured to radiate the generated heat is mounted to the power supply control component. However, the cooling efficiency of the power supply control component to be attained by only mounting the heat sink is still low.

In view this, the cooling efficiency of the heat sink to be mounted to the power supply control component is improved by utilizing an air flow generated by the air-sending fan. Further, there has been known a configuration in which each fin of the heat sink and a cover that covers a distal end of each fin are integrated with each other such that the entire heat sink is efficiently cooled (see, for example, Patent Literature 1).

CITATION LIST

Patent Literature

[PTL 1] JP 2009-299907 A

SUMMARY OF INVENTION

Technical Problem

However, in the structure of Patent Literature 1, the pressure loss of the air flow passing between the fins of the heat sink is large. Therefore, there is a problem in that the speed of the air flow passing between the fins is decreased, and the flow rate of the air flow passing between the fins is reduced, with the result that the cooling effect by the heat sink cannot be sufficiently obtained.

The present invention has been made in order to solve the problem as described above, and obtains a cooling structure capable of improving the cooling efficiency achieved by a heat sink, and an outdoor unit including the cooling structure.

Solution to Problem

A cooling structure according to the present invention, includes: a heat sink to be mounted to a heat generator; and a duct mounted to the heat sink and configured to guide an air flow flowing around the heat sink to the heat sink, wherein the heat sink has an air flow passage configured to allow the air flow to pass through the air flow passage, wherein one end side of the duct is to be mounted to an upstream side of the air flow passage, and wherein another end side of the duct is extended from an upstream end portion of the air flow passage to an upstream side of the air flow.

Advantageous Effects of Invention

In the present invention, the duct extended from the heat sink is mounted to the upstream side of the air flow passage of the heat sink, which is configured to cool the heat generator such that a large amount of air flow is guided to the air flow passage. With this, the flow rate of the air flow passing through the air flow passage of the heat sink can be increased, and the cooling efficiency of the heat sink can be improved.

DESCRIPTION OF EMBODIMENTS

Now, with reference to the drawings, a cooling structure and an outdoor unit including the cooling structure according to exemplary embodiments of the present invention is described. The embodiments described below are merely examples, and the present invention is not limited to those embodiments.

First Embodiment

Figure 1:
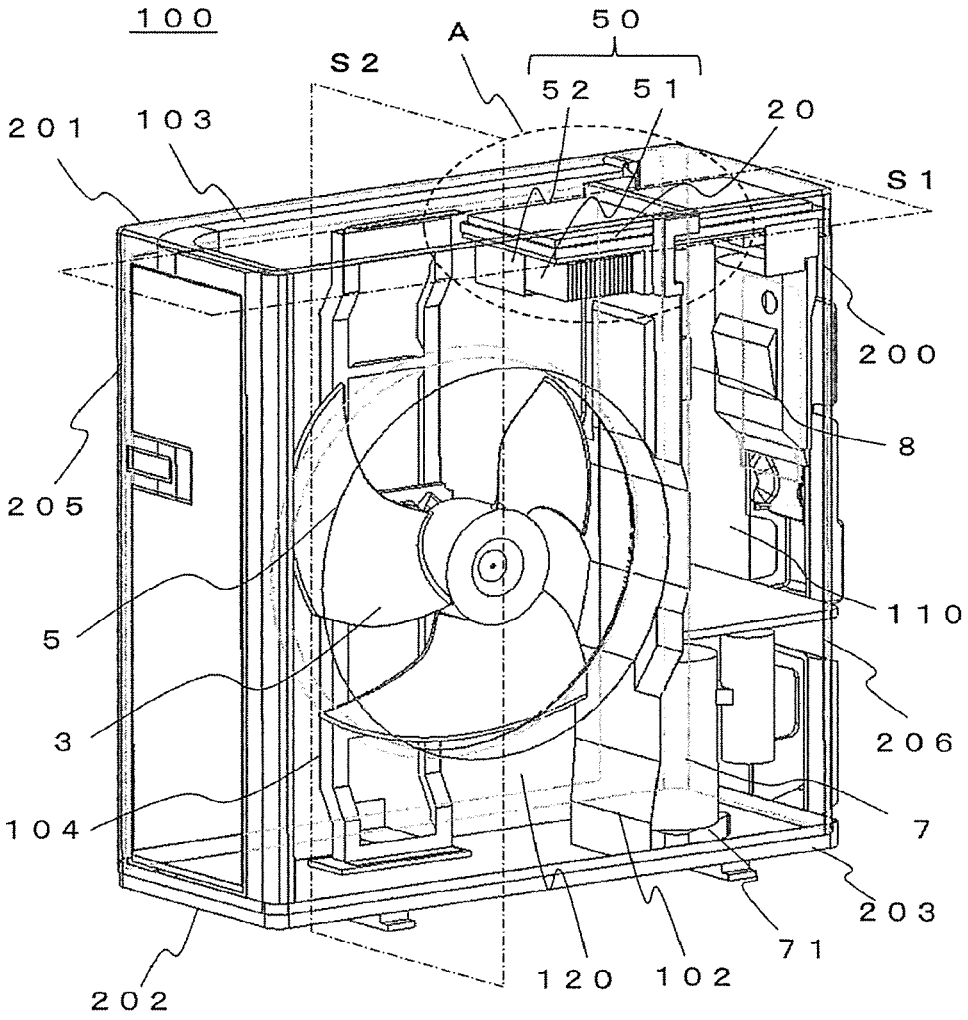
FIG. 1 is a perspective view of an outdoor unit including a cooling structure according to a first embodiment of the present invention as viewed from the front in a state in which a part of a casing is transparent.
Figure 2:
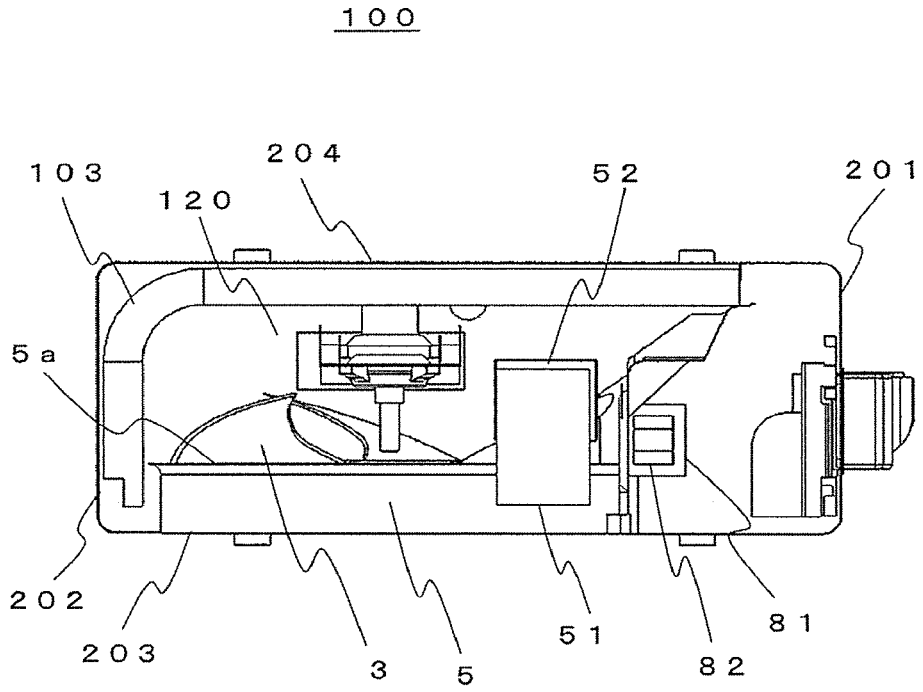
FIG. 2 is a sectional view of the outdoor unit taken along the plane S1 of FIG. 1 as viewed from above.
Figure 3:
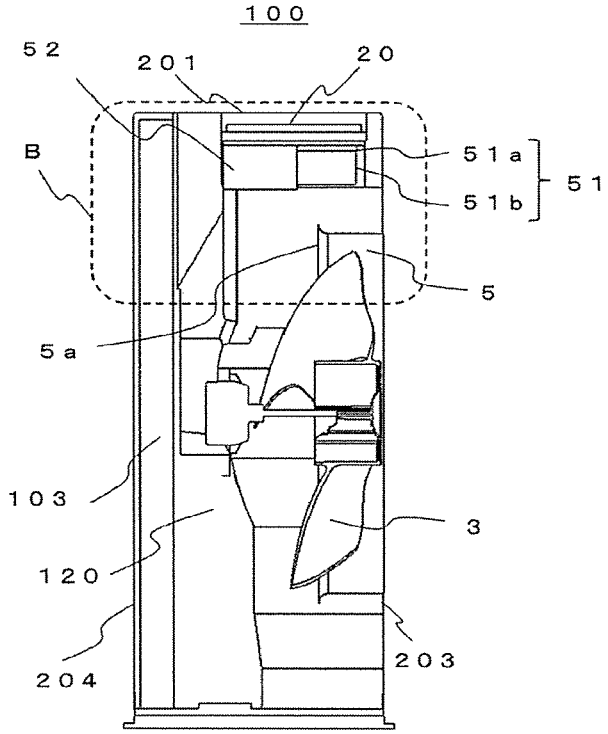
FIG. 3 is a sectional view of the outdoor unit taken along the plane S2 of FIG. 1 as viewed from a fan chamber side.
Figure 4:
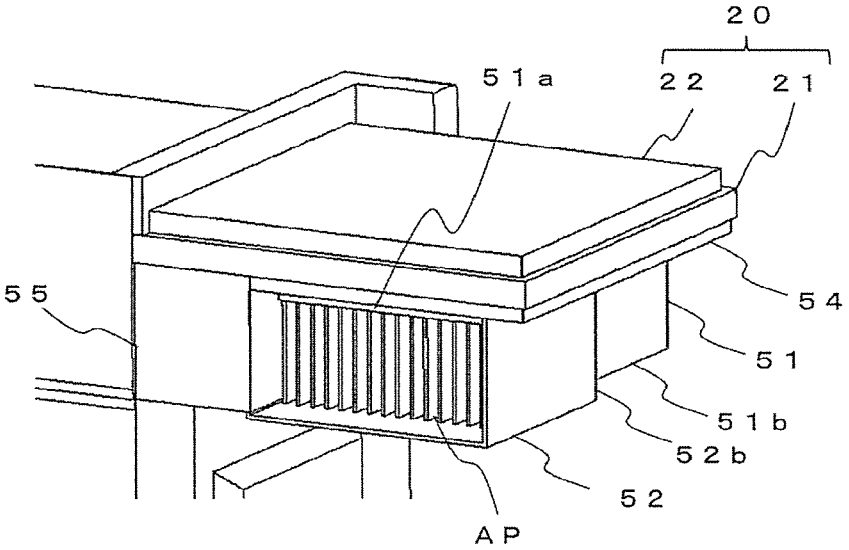
FIG. 4 is an enlarged view of the part A of FIG. 1 as viewed from the back side.
Figure 5:
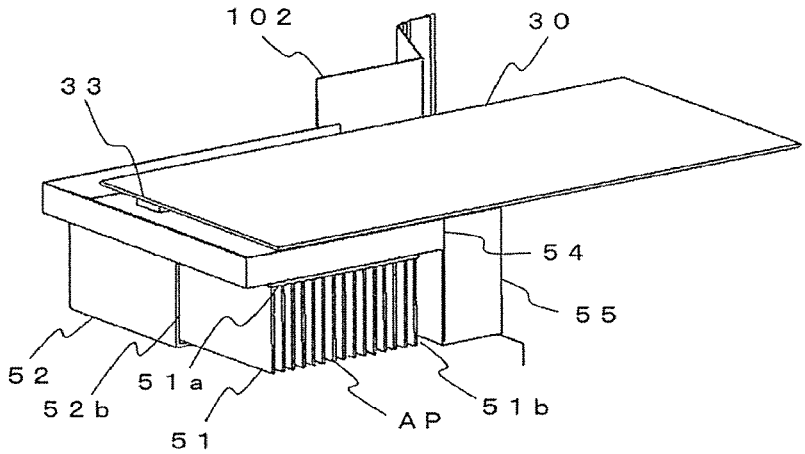
FIG. 5 is an enlarged view of the part A of FIG. 1.
Figure 6:
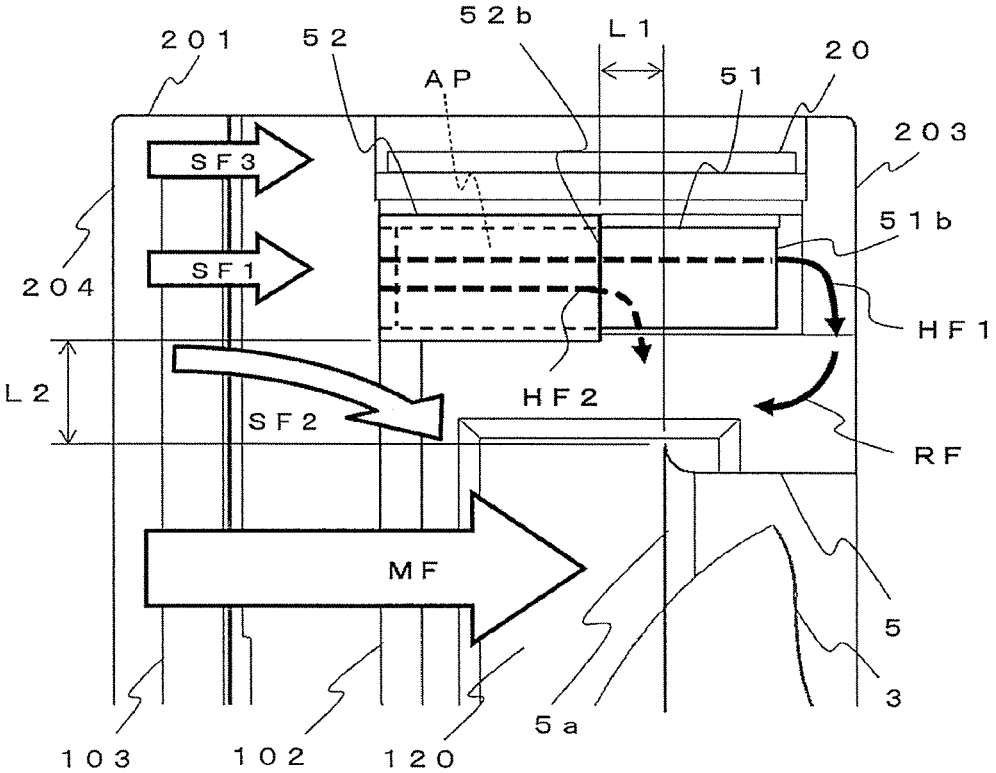
FIG. 6 is an enlarged view of the part B of FIG. 3.

FIG. 1 is a perspective view of an outdoor unit 100 including a cooling structure according to a first embodiment of the present invention as viewed from a front under a state in which a part of a casing 200 is transparent. FIG. 2 is a sectional view for illustrating the outdoor unit 100 taken along the plane S1 of FIG. 1. FIG. 3 is a sectional view for illustrating the outdoor unit 100 taken along the plane S2 of FIG. 1. Further, FIG. 4 is an enlarged view of the part A of FIG. 1 as viewed from the back side. FIG. 5 is an enlarged view of the part A of FIG. 1. FIG. 6 is an enlarged view of the part B of FIG. 3. In FIG. 5, a state in which a lid 22 of an electric component box 20 is removed is illustrated.

Further, for convenience of description, in the outdoor unit 100 of FIG. 1, the front of the outdoor unit 100 may be referred to as a front side, a back thereof may be referred to as a back side, a left side as viewed from the front may be referred to as a fan chamber side, and a right side as viewed from the front may be referred to as a machine chamber side.

FIG. 1 is a perspective view of the outdoor unit 100 for an air conditioner, which includes a cooling structure 50, according to the first embodiment as viewed from the front.

The outdoor unit 100 is installed outdoors. The outdoor unit 100 is connected to an indoor unit (not shown) installed indoors by a refrigerant pipe to form a refrigeration cycle. The indoor unit and the outdoor unit 100 are connected to each other by a power supply line and a signal line configured to control an operation of the refrigeration cycle.

As illustrated in FIG. 1 to FIG. 3, the outdoor unit 100 includes the casing 200. FIG. 1 is an illustration of the state in which a part of the casing 200 is transparent. In an inside of the casing 200, there are accommodated the electric component box 20 receiving a power supply control component 33 (see FIG. 5) serving as a heat generator, the cooling structure 50 configured to cool the power supply control component 33, and a heat exchanger 103. The cooling structure 50 includes a heat sink 51 mounted to the power supply control component 33, and a duct 52 configured to guide an air flow surrounding the heat sink 51 to the heat sink 51.

The casing 200 includes a top panel 201, a bottom panel 202, a front panel 203, a back panel 204, a side panel 205, and a side panel 206, which are formed by sheet metal processing. The top panel 201, the bottom panel 202, the front panel 203, the back panel 204, the side panel 205, and the side panel 206 each may be formed as an independent panel, or two or more panels such as the back panel 204 and the side panel 205 may be integrated with each other.

The inside of the casing 200 is divided into two spaces arranged in a right and left lateral direction by a partition plate 102 formed by sheet metal processing. One space is a machine chamber 110 located on the right side as viewed from the front of FIG. 1. Another space is a fan chamber 120 located on the left side as viewed from the front of FIG. 1. The upper portions of the machine chamber 110 and the fan chamber 120 are covered by the top panel 201.

In the machine chamber 110, there are arranged the electric component box 20, a compressor 7, a reactor 8, the refrigerant pipe (not shown), and the like. The compressor 7 has a function of causing the refrigerant to circulate through the refrigeration cycle. The compressor 7 is fixed to the bottom panel 202 through intermediation of an anti-vibration rubber 71.

The reactor 8 is mounted above the compressor 7. The reactor 8 has a function of improving a power factor of an AC power supply. The reactor 8 includes a core 81, a coil 82 such as a copper wire, and a base plate made of metal (not shown). The core 81 is obtained by stacking magnetic steel sheets. The coil 82 is wound around the core 81. The base plate is welded to an end surface of the core 81. The base plate of the reactor 8 is fixed to the partition plate 102 with a fixing member such as a screw.

The electric component box 20 is arranged above the reactor 8. The electric component box 20 is arranged across the machine chamber 110 and the fan chamber 120 above the partition plate 102. In the machine chamber 110, there are further arranged an expansion valve, a four-way valve, a refrigerant pipe, and the like forming the refrigeration cycle. Further, in the machine chamber 110, there are arranged a wire for connecting electrical components, and the like.

Meanwhile, in the fan chamber 120, there are arranged the electric component box 20, an air-sending fan 3, the heat exchanger 103, and a bellmouth 5 serving as an exhaust port of the casing 200. The air-sending fan 3 is fixed to a support plate 104 provided inside the casing 200 with a screw.

The heat exchanger 103 has an L shape, and is arranged along the side panel 205 on the fan chamber side of the casing 200 and the back panel 204. Inlet ports (not shown) formed by a plurality of through holes are formed in the side panel 205 and the back panel 204. When the air-sending fan 3 is rotated, outside air is taken into the fan chamber 120 through the inlet ports.

The heat exchanger 103 includes a plurality of fins made of metal and a plurality of refrigerant pipes passing through the plurality of fins. The outside air having been taken into the fan chamber 120 passes between the plurality of fins of the heat exchanger 103. The heat exchanger 103 exchanges heat between the air passing between the plurality of fins and refrigerant flowing through the refrigerant pipes.

The bellmouth 5 is arranged on the fan chamber 120 side of the front panel 203. An annular protruding portion **5*a* protruding to the inner side of the casing 200 is formed on a peripheral edge portion of an opening of the bellmouth 5. The protruding portion 5*a* is configured to guide an air flow generated by the air-sending fan 3 to a direction of being exhausted through the bellmouth 5**.

FIG. 4 is an enlarged view of the part A of FIG. 1 as viewed from the back side. As illustrated in FIG. 4, the electric component box 20 includes a cover 21 made of resin and the lid 22 made of metal.

An electric circuit board 30 is accommodated in the electric component box 20. The electric circuit board 30 includes a printed circuit board and a plurality of electronic components mounted on the printed circuit board. The electric circuit board 30 is configured to control a power supply of the air conditioner and control an operation of a device such as the compressor 7.

The periphery of the printed circuit board of the electric circuit board 30 and a surface opposite to the mounting surface of the printed circuit board are covered by the cover 21. The electric circuit board 30 is fixed to the cover 21 with a screw. The cover 21 is fixed to the partition plate 102 with a screw. The lid 22 is mounted on the cover 21 with a screw or by snap-fitting.

In FIG. 5, the part A of FIG. 1 is enlarged, and the state in which the cover 21 and the lid 22 forming the electric component box 20 are removed is illustrated.

In a region of the electric circuit board 30 on the fan chamber 120 side, the power supply control component 33 being a power device is mounted. The power supply control component is mounted to the electric circuit board 30 through intermediation of a spacer made of resin. A terminal of the power supply control component 33 is soldered to the electric circuit board 30. The power supply control component 33 is a component having the largest heat generation amount among the plurality of electronic components mounted on the electric circuit board 30.

As illustrated in FIG. 5, the heat sink 51 configured to radiate heat generated from the power supply control component 33 is mounted to the power supply control component 33. The heat sink 51 includes a heat sink base plate 51*a* and a plurality of heat-radiating fins 51*b*.

The periphery of the heat sink base plate 51*a* is supported by a heat sink holder 54 made of resin in a downward direction, that is, a gravity direction. The heat sink holder is fixed to a heat sink support 55 formed by sheet metal processing with a screw. The heat sink support 55 is fixed to the partition plate 102 with a screw, or the like.

The plurality of heat-radiating fins 51*b* are arranged on one surface of the heat sink base plate 51*a*. Each of the heat-radiating fins 51*b* is a plate-shaped member extending downward perpendicularly from the heat sink base plate 51*a*, and has rectangular heat radiation surfaces on the front and back. The heat-radiating fins 51*b* are arranged at given intervals from each other.

Another surface of the heat sink base plate 51*a*, that is, a surface opposite to the surface on which the heat-radiating fins 51*b* are provided is brought into abutment against the power supply control component 33 through heat conductive grease or a heat conductive sheet.

An end portion of the heat sink base plate 51*a* on the heat sink support 55 side extends in a direction of the heat sink support 55 with respect to the heat-radiating fin 51*b* located at an end portion of the plurality of heat-radiating fins 51*b* on the heat sink support 55 side. Meanwhile, an end portion of the heat sink base plate 51*a* opposite to the heat sink support 55 extends in a direction opposite to the heat sink support 55 with respect to the heat-radiating fin 51*b* located at an end portion of the plurality of heat-radiating fins 51*b* opposite to the heat sink support 55.

A gap between the adjacent heat-radiating fins 51*b* of the plurality of heat-radiating fins 51*b* forms air flow passages AP. The air flow passage AP is formed with the heat sink base plate 51*a* as a top surface and the heat radiation surfaces of the adjacent heat-radiating fins 51*b* as both side surfaces. A bottom side, that is, a downward direction of the air flow passage AP is opened to the outside.

As illustrated in FIG. 4 and FIG. 5, the duct 52 configured to guide an air flow to the air flow passages AP is mounted to a side being an inlet side of the air flow passages AP, and faces the back side of the outdoor unit 100. The duct 52 is made of resin, and is fixed to the heat sink support 55.

The duct 52 has an L shape in cross section taken along a perpendicular plane. That is, the duct 52 includes a side plate opposite to the heat sink support 55, and a bottom plate opposite to the heat sink holder 54. A direction of the duct 52 on the back side of the outdoor unit 100, that is, a direction of an upstream side of the air flow passages AP is opened.

The duct 52 may include one or both of a side plate on the heat sink support 55 side and a top plate facing the heat sink holder 54. When the top plate is provided on the duct 52, it is preferred that a cutout or an opening be formed in the top plate in order to avoid interference with the region in which the heat sink base plate 51*a* and the power supply control component 33 are held in contact with each other.

The inlet of the air flow passage AP is formed by an end portion of each of the heat-radiating fins 51*b*. In the air flow flowing toward the air flow passages AP, an air flow that collides with the end portion of each of the heat-radiating fins 51*b* becomes a turbulent flow in the vicinity of the inlets of the air flow passages AP. The turbulent flow in the vicinity of the inlets of the air flow passages AP hinders a flow of the air flow introduced into the air flow passages AP. Thus, the flow rate of the air flow passing through the air flow passages AP is reduced.

In view of this, as illustrated in FIG. 4, in the cooling structure 50 according to the first embodiment, the end portion of the duct 52 in the back side direction of the outdoor unit 100 is extended from the inlets of the air flow passages AP to the back side of the outdoor unit 100, that is, the back panel 204 direction. The length of extending the end portion of the duct 52 is set to be larger than the interval at which the heat-radiating fins 51*b* are arranged. The periphery of the inlets of the air flow passages AP is surrounded by the heat sink base plate 51*a*, the heat sink support 55, and the side plate and the bottom plate of the duct 52.

With this, even when the flow of the air current toward the air flow passages AP is disturbed by the turbulent flow in the vicinity of the inlets of the air flow passages AP, the disturbed air flow is suppressed from flowing toward the outside of the air flow passages AP. Accordingly, reduction in the flow rate of the air flow passing through the air flow passages AP can be suppressed.

FIG. 6 is an enlarged view of the part B of FIG. 3. Through rotation of the air-sending fan 3, air in the fan chamber 120 is exhausted to the outside through the opening of the bellmouth 5. Then, the inside of the fan chamber 120 becomes a negative pressure, and the outside air is taken into the fan chamber 120 through the inlet ports of the back panel 204. The outside air having been taken into the fan chamber 120 passes through the heat exchanger 103 to become a plurality of air flows as indicated by, for example, the white arrows shown in FIG. 6.

Among the plurality of air flows illustrated in FIG. 6, an air flow linearly exhausted to the outside through the opening of the bellmouth 5 from the back side of the outdoor unit 100 to the front side is defined as a main flow MF, and other air flows are defined as subsidiary flows SF. The heat sink 51 is arranged so that the direction of the air flow passages AP matches the direction of the main flow MF. In the following, based on the flowing direction of the main flow MF being a reference, a side of each element, which corresponds to the back side of the outdoor unit 100, may be referred to as an upstream side, and a side of each element, which corresponds to the front side of the outdoor unit 100, may be referred to as a downstream side.

In FIG. 6, three subsidiary flows SF1 to SF3 are illustrated. The subsidiary flow SF1 is an air flow flowing toward the air flow passages AP of the heat sink 51. The subsidiary flow SF2 is an air flow flowing downward from below the heat sink 51 toward the opening of the bellmouth 5. The subsidiary flow SF3 is an air flow flowing toward a gap defined between an upper surface of the electric component box 20 and the top panel 201.

Further, although not illustrated in FIG. 6, an air flow flowing from the machine chamber 110 side to the fan chamber 120 side is also present on the side of the heat sink 51 being the inlet side of the air flow passages AP and facing the back side of the outdoor unit 100.

Here, the downstream end portions of the air flow passages AP formed by the plurality of heat-radiating fins 51*b* extend toward the vicinity of the front panel 203. Therefore, when the lower side of the air flow passages AP that are opened is entirely covered by the bottom plate of the duct 52, it is difficult for the air flow to pass through the air flow passages AP, and the flow speed of the air flow in the air flow passages AP is decreased. Further, when the lower side of the air flow passages AP that is opened is entirely covered by the bottom plate of the duct 52, all the air flows passing through the air flow passages AP collide with the inner wall of the front panel 203.

The air flow that collides with the inner wall of the front panel 203 is, for example, bent downward as in an air flow HF1 illustrated in FIG. 6, and thus the flow speed is decreased. The air flow HF1 decreased in the flow speed stagnates between the downstream end portions of the air flow passages AP and the front panel 203, and thus hinders the air flow passing through the air flow passages AP. Consequently, the speed of the air flow flowing through the air flow passages AP is decreased. As a result, the flow rate of the air flow in the air flow passages AP is reduced, and hence the heat radiation effect of the heat sink 51 is reduced.

Further, the air flow HF1 having collided with the inner wall of the front panel 203 flows along the inner wall of the front panel 203. A part of the air flow flowing along the inner wall of the front panel 203 flows in a direction opposite to the main flow MF, as in an air flow RF illustrated in FIG. 6, with the partition plate 102 and the protruding portion 5*a* of the bellmouth 5 serving as barriers.

The air flow RF flowing in the opposite direction collides with the subsidiary flow SF2 flowing to the front side, and disturbs the flow of the subsidiary flow SF2. When the flow of the subsidiary flow SF2 is disturbed, the flow of the subsidiary flow SF1 flowing above the subsidiary flow SF2 becomes unstable. When the flow of the subsidiary flow SF1 becomes unstable, the flow rate of the air flow introduced into the air flow passages AP is reduced. Consequently, the speed of the air flow flowing through the air flow passage AP is further decreased. As a result, the heat radiation effect of the heat sink 51 is further reduced.

In view of this, as illustrated in FIG. 4 to FIG. 6, in the cooling structure 50 according to the first embodiment, a downstream end portion 52*b* of the duct 52 is arranged at the middle position of the air flow passages AP. In addition, the upstream side of the air flow passages AP is covered by the duct 52, and the downstream side of the air flow passages AP is exposed. With this, a part of the air flow passing through the air flow passages AP flows out from the vicinity of the middle of the air flow passages AP to the outside of the air flow passages AP as in an air flow HF2 illustrated in FIG. 6.

With this, the ratio of the air flow HF1 that collides with the inner wall of the front panel 203 to the air flow passing through the air flow passages AP can be reduced. Accordingly, reduction in speed of the air flow in the air flow passages AP, which is caused due to stagnation of the air flow HF1 in the vicinity of the outlets of the air flow passages AP, can be suppressed. Further, the air flow RF flowing in the direction opposite to the main flow MF below the heat sink 51 can be reduced. In addition, generation of the air flow that collides with the subsidiary flow SF2 to disturb the flows of the subsidiary flow SF2 and the subsidiary flow SF1 can be suppressed.

Further, as illustrated in FIG. 6, in the cooling structure 50 according to the first embodiment, the downstream end portion 52*b* of the duct 52 is arranged at a position spaced away by a length L1 to the upstream side of the air flow with respect to an upstream end portion of the protruding portion 5*a* of the bellmouth 5. Moreover, the lower surface of the duct 52 is arranged at a position spaced away by a length L2 to the upper side with respect to an uppermost portion of the protruding portion 5*a* of the bellmouth 5. The length L1 and the length L2 are appropriately determined based on the shape of the fan chamber 120, arrangement of each element, and the flow of the air flow analyzed based on the performance of the air-sending fan 3, and the like.

With this, the protruding portion 5*a* of the bellmouth 5 is suppressed from becoming the barrier of the air flow HF2, and the air flow HF2 can be efficiently directed to the opening of the bellmouth 5.

As described above, in the cooling structure 50 according to the first embodiment, through arrangement of the duct 52, the decrease of the flow speed of the air flow passing through the air flow passages AP and the reduction in flow rate of the air flow introduced into the air flow passages AP are suppressed. As a result, the reduction of the heat radiation effect of the heat sink 51 can be suppressed.

Next, actions of the cooling structure 50 according to the first embodiment are described.

When electric power is supplied to the air conditioner to operate the refrigeration cycle, power is supplied to the electric circuit board 30 of the outdoor unit 100. Then, the power supply control component 33 mounted to the electric circuit board 30 starts control of a power supply configured to energize a device such as a motor of the air-sending fan 3 to generate heat. When the motor of the air-sending fan 3 is energized, the air-sending fan 3 is rotated. When the air-sending fan 3 is rotated, air in the fan chamber 120 is exhausted through the opening of the bellmouth 5.

When the air in the fan chamber 120 is exhausted, the pressure inside the casing 200 becomes a negative pressure with respect to the outside. When the pressure inside the casing 200 becomes a negative pressure with respect to the outside, the outside air is taken into the fan chamber 120 through the plurality of inlet ports formed in the back panel 204 and the side panel 205.

The outside air having been taken into the fan chamber 120 becomes an air flow in the fan chamber 120, and passes between the plurality of fins of the heat exchanger 103. The air flow passing between the plurality of fins of the heat exchanger 103 exchanges heat with refrigerant flowing through the refrigerant pipes. During a cooling operation of the air conditioner, the refrigerant gives heat to the air flow, and hence the temperature of the air flow passing through the heat exchanger 103 is higher than the temperature of the outside air. Meanwhile, during a heating operation of the air conditioner, the refrigerant takes heat from the air flow. Thus, the temperature of the air flow passing through the heat exchanger 103 becomes lower than the temperature of the outside air.

In the air flow generated in the fan chamber 120, the main flow MF is linearly exhausted from the back side of the outdoor unit 100 to the front side through the opening of the bellmouth 5. Meanwhile, the subsidiary flows SF other than the main flow MF perform a direction change to be exhausted through the opening of the bellmouth 5.

Some of the subsidiary flows SF are guided to the duct 52 to be introduced into the air flow passages AP of the heat sink 51. Some of the subsidiary flows SF having been introduced into the air flow passages AP become the air flow HF1 that flows straight through the air flow passages AP and collide with the front panel 203 and the air flow HF2 flowing from the middle of the air flow passages AP to the outside of the air flow passages AP. The ratio of the flow rates of the air flow HF1 and the air flow HF2 varies depending on, for example, the positional relationship between the heat sink 51 and the air-sending fan 3.

The air flow HF1 and the air flow HF2 take heat from the heat-radiating fins 51*b* of the heat sink 51 when passing through the air flow passages AP. The heat-radiating fins 51*b* lowered in the temperature take heat from the heat sink base plate 51*a*. The heat sink base plate 51*a* lowered in the temperature takes heat from the power supply control component 33 held in contact with the heat sink base plate 51*a* with the heat conductive grease or the heat conductive sheet. With this, heat generated from the power supply control component 33 is radiated.

In the cooling structure 50 according to the first embodiment, among the end portions of the duct 52 on the back side of the outdoor unit 100, only the side plate and the bottom plate are extended to the back side of the outdoor unit 100, that is, in the upstream side direction of the air flow. However, the shape of the duct 52 is not limited thereto. For example, only one of the side plate and the bottom plate may be extended. Further, when the duct 52 includes the top plate and the side plate on the heat sink support 55 side, the top plate, the bottom plate, and both the side plates of the duct 52 may be appropriately extended in accordance with a positional relationship between the heat sink 51 and a peripheral device such as the air-sending fan 3.

Further, in the cooling structure 50 according to the first embodiment, the outdoor unit 100 includes one air-sending fan 3, but the number of the air-sending fans 3 is not limited thereto. For example, two or more air-sending fans 3 may be arranged. In this case, the end portions of the duct 52 on the +Y side are appropriately extended in accordance with the air flow generated in the fan chamber 120 so that the same effects as those of the first embodiment can be obtained.

Second Embodiment

Figure 7:
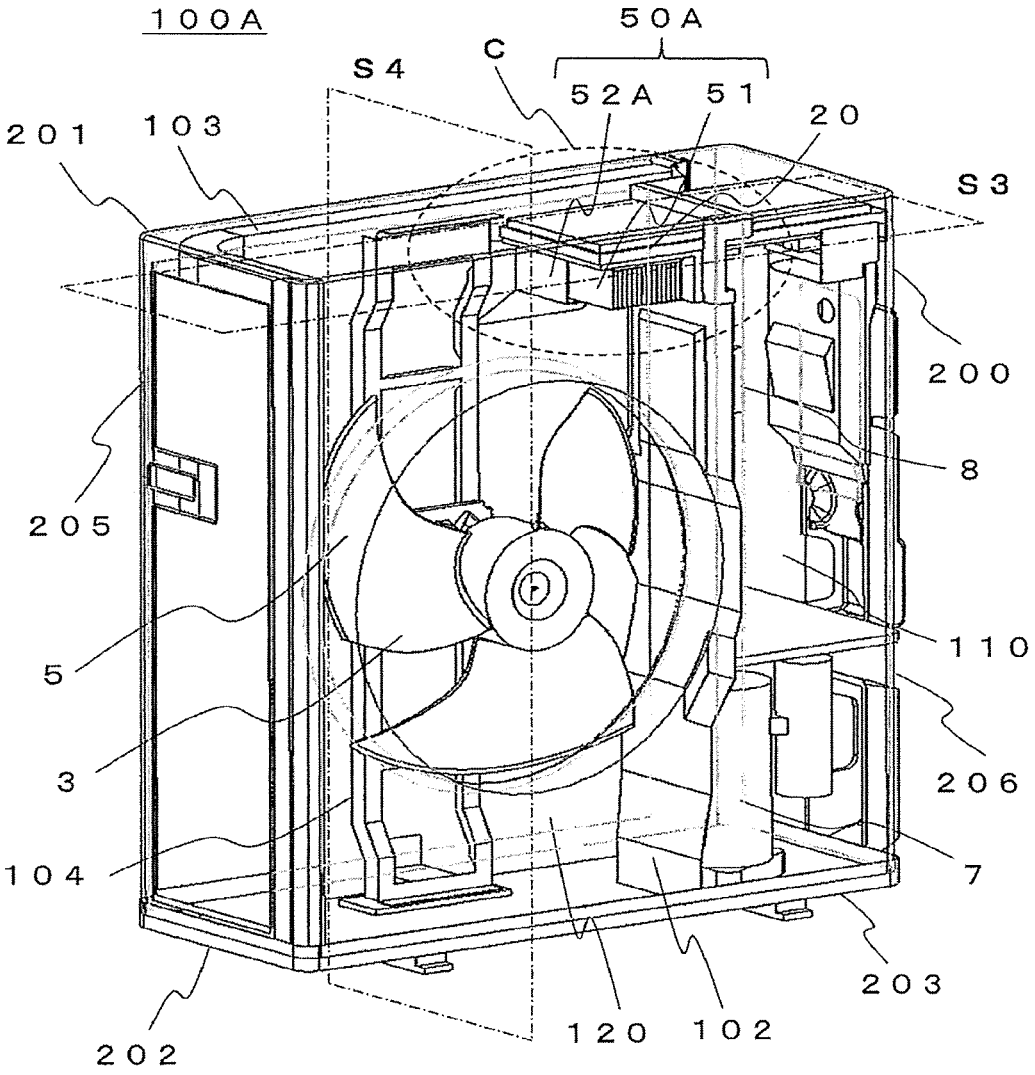
FIG. 7 is a perspective view of an outdoor unit including a cooling structure according to a second embodiment of the present invention as viewed from the front in a state in which a part of the casing is transparent.
Figure 8:
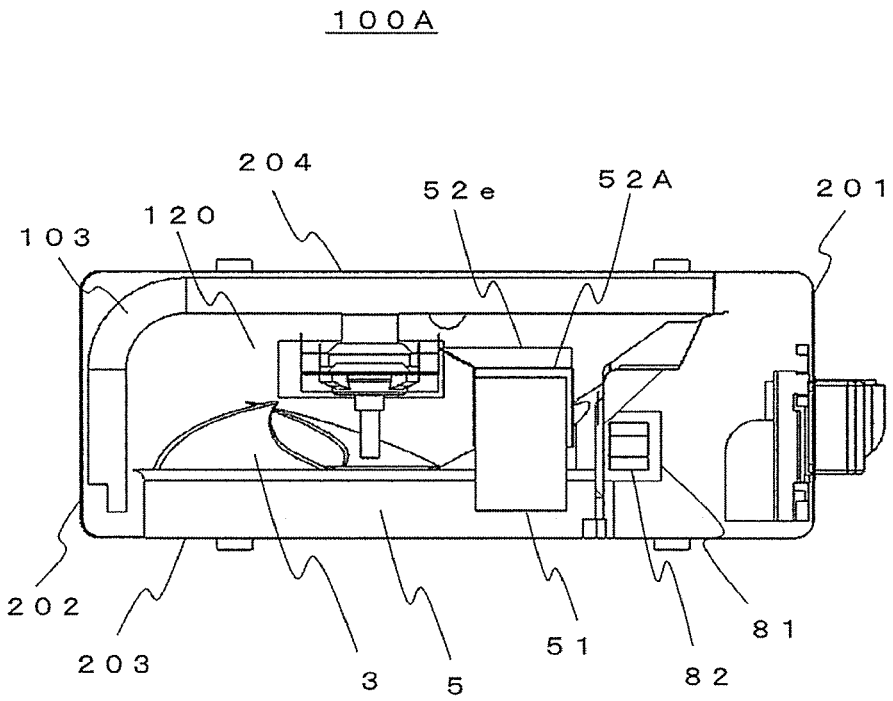
FIG. 8 is a sectional view of the outdoor unit taken along the plane S3 of FIG. 7 as viewed from above.
Figure 9:
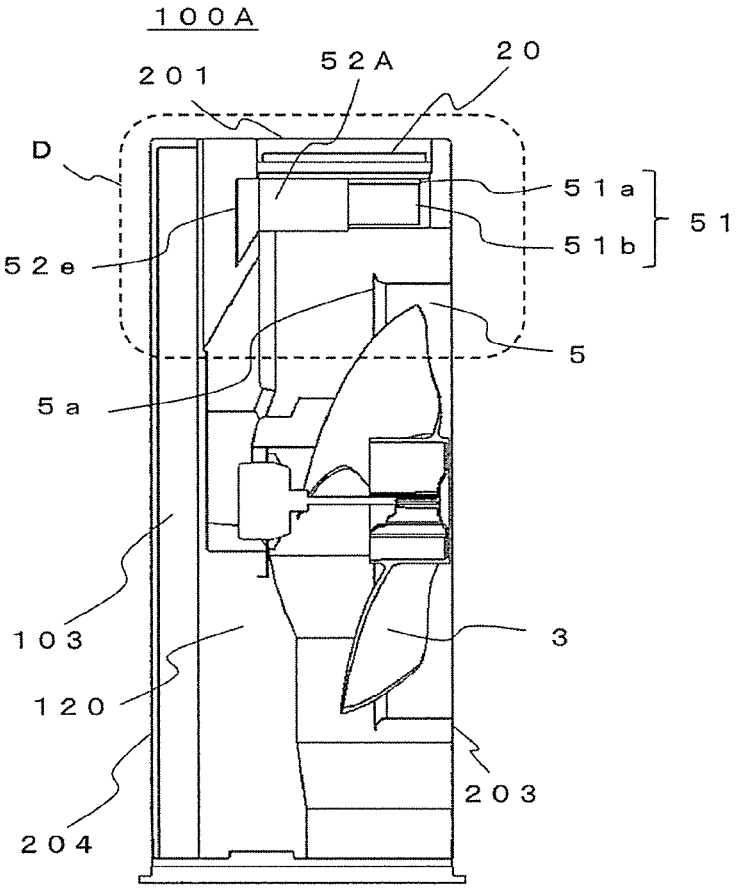
FIG. 9 is a sectional view of the outdoor unit taken along the plane S4 of FIG. 7 as viewed from the fan chamber side.
Figure 10:
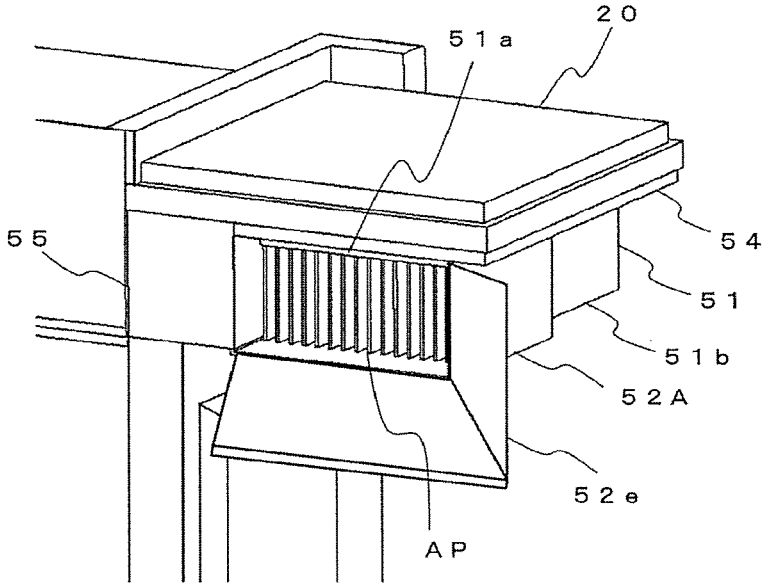
FIG. 10 is an enlarged view of the part C of FIG. 7 as viewed from the back side.
Figure 11:
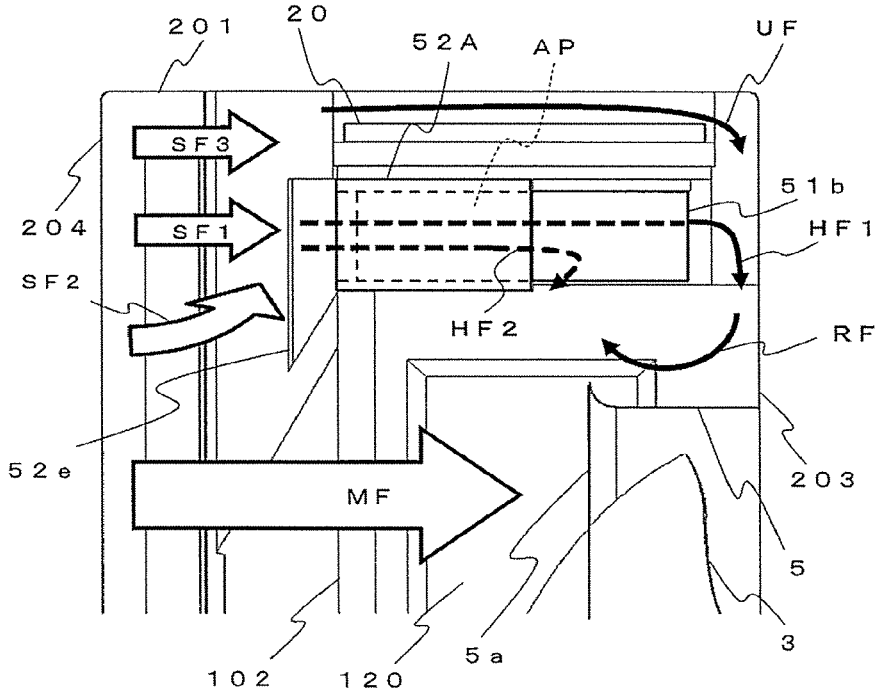
FIG. 11 is an enlarged view of the part D of FIG. 9.

FIG. 7 is a perspective view of an outdoor unit 100A including a cooling structure 50A according to a second embodiment as viewed from the front in a state in which a part of the casing 200 is transparent. FIG. 8 is a sectional view of the outdoor unit taken along the plane S3 of FIG. 7 as viewed from above. FIG. 9 is a sectional view of the outdoor unit taken along the plane S4 of FIG. 7 as viewed from the fan chamber side. FIG. 10 is an enlarged view of the part C of FIG. 7 as viewed from the back side. FIG. 11 is an enlarged view of the part D of FIG. 9.

The cooling structure 50A according to the second embodiment is different from the cooling structure 50 according to the first embodiment in a shape of an end portion of a duct 52A on the back side of the outdoor unit 100. Other configurations are the same as those of the first embodiment.

As illustrated in FIG. 8 to FIG. 10, in the duct 52A in the cooling structure 50A according to the second embodiment, an extending portion 52*e* is formed on the end portion on the back side of the outdoor unit 100, that is, the upstream side of the air flow.

The extending portion 52*e* is formed by extending the side plate at an angle of 45° from the end portion on the back side of the outdoor unit 100 outward in the lateral and downward directions. Further, the extending portion 52*e* is formed by extending the bottom plate at an angle of 45° from the end portion on the back side of the outdoor unit 100 outward in the downward and lateral directions. That is, the side plate and the bottom plate of the extending portion 52*e* are extended in a direction in which an opening of the duct 52A becomes larger as being spaced away from the heat sink 51, that is, as approaching to the back panel 204.

FIG. 11 is an enlarged view of the part D in FIG. 9 and is an explanatory view of the flow of the air flow. As illustrated in FIG. 11, the extending portion 52*e* formed on the duct 52A is configured to guide, to the air flow passages AP, the subsidiary flow SF2 flowing below the heat sink 51 as well as the subsidiary flow SF1 flowing linearly toward the air flow passages AP of the heat sink 51.

Further, although not illustrated in FIG. 11, with the extending portion 52*e* formed on the duct 52A, on the side of the heat sink 51 being the inlet side of the air flow passages AP and facing the back side of the outdoor unit 100, the air flow flowing from the machine chamber 110 side to the fan chamber 120 side is also guided to the air flow passages AP.

As described above, in the cooling structure 50A according to the second embodiment, with the extending portion 52*e* formed on the duct 52A, a larger amount of the air flow flowing on the upstream side of the heat sink 51 can be guided to the air flow passages AP. With this, the flow rate of the air flow passing through the air flow passages AP can be increased. Accordingly, the heat radiation effect of the heat sink 51 can be improved.

In the cooling structure 50A according to the second embodiment, the angle of expansion of each of the side plate and the bottom plate of the extending portion 52*e* is 45° from the end portion on the back side of the outdoor unit 100. However, the angle of expansion of each of the side plate and the bottom plate is not limited thereto. For example, the angle of expansion of each of the side plate and the bottom plate may be 45° or more or less than 45° from the end portion on the back side of the outdoor unit 100. Further, the angles of expansions of the side plate and the bottom plate may be set to be different from each other. The angle of expansion of each of the side plate and the bottom plate is appropriately determined in accordance with, for example, the direction or the flow rate of the air flow generated around the heat sink 51.

Figure 12:
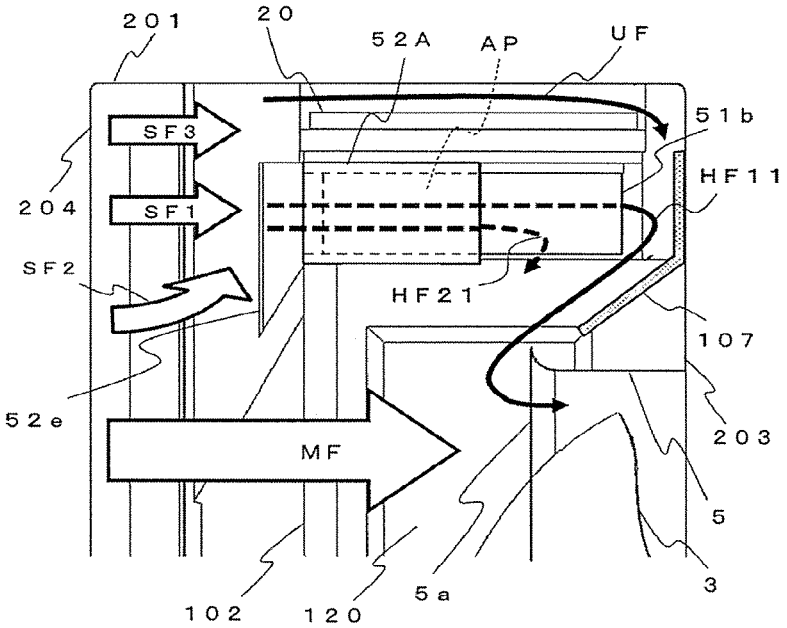
FIG. 12 is a view of a first modification example of the cooling structure according to the second embodiment of the present invention as viewed from the same position as that of FIG. 11.

Further, as in a first modification example illustrated in FIG. 12, a baffle plate 107 may be mounted to the inner wall of the front panel 203, which faces the outlets of the air flow passages AP.

The gap is defined between the electric component box 20 and the top panel 201. A part of the subsidiary flow SF3 becomes an air flow UF flowing through the gap from the upstream side to the downstream side. The air flow UF collides with the front panel 203, and flows downward along the inner wall of the front panel 203. The air flow UF flowing downward along the inner wall of the front panel 203 flows into the vicinity of the outlets of the air flow passages AP. The air flow UF having flowed into the vicinity of the outlets of the air flow passages AP passes through the air flow passages AP, and is merged into an air flow HF11 that collides with the front panel 203.

When the baffle plate 107 is not provided, as illustrated in FIG. 11, the air flow UF having been merged into the air flow HF1 collides with the protruding portion 5*a* of the bellmouth 5 to be changed in direction to an upward direction, and becomes the air flow RF flowing reverse to the main flow MF. Further, the air flow RF is caused to collide with the air flow HF2 flowing out from the vicinity of the middle of the air flow passages AP to the outside of the air flow passages AP. Then, the flow speed of the air flow HF2 flowing out from the air flow passages AP is decreased. As a result, the flow rate of the air flow flowing through the air flow passages AP is reduced, and hence the heat radiation effect of the heat sink 51 is reduced.

The baffle plate 107 to be mounted to the inner wall of the front panel 203 is bent at an obtuse angle by sheet metal processing. Then, the baffle plate 107 is mounted to the inner wall of the front panel 203 with a fastening member such as a screw or by welding. The bending portion of the baffle plate 107 is set to an obtuse angle in order to suppress the decrease in speed of the air flow. The bending portion of the baffle plate 107 may have a curved shape.

As illustrated in FIG. 12, the baffle plate 107 is mounted so that the bending portion is directed downward from the inner wall of the front panel 203 toward the back panel 204. In this case, the end portion of the baffle plate 107 on the lower side is mounted so as to be directed to the end portion of the protruding portion 5*a* of the bellmouth 5 on the upper side.

The air flow HF11 passing through the air flow passages AP is guided to the opening of the bellmouth 5 along the baffle plate 107 mounted to the front panel 203. With this, generation of the air flow RF is suppressed, and an air flow HF21 flows toward the opening of the bellmouth 5 without colliding with the air flow RF. As a result, the heat radiation effect of the heat sink 51 is improved.

The shape and the arrangement of the baffle plate 107 can be appropriately changed depending on the positional relationship between the heat sink 51 and the bellmouth 5.

Figure 13:
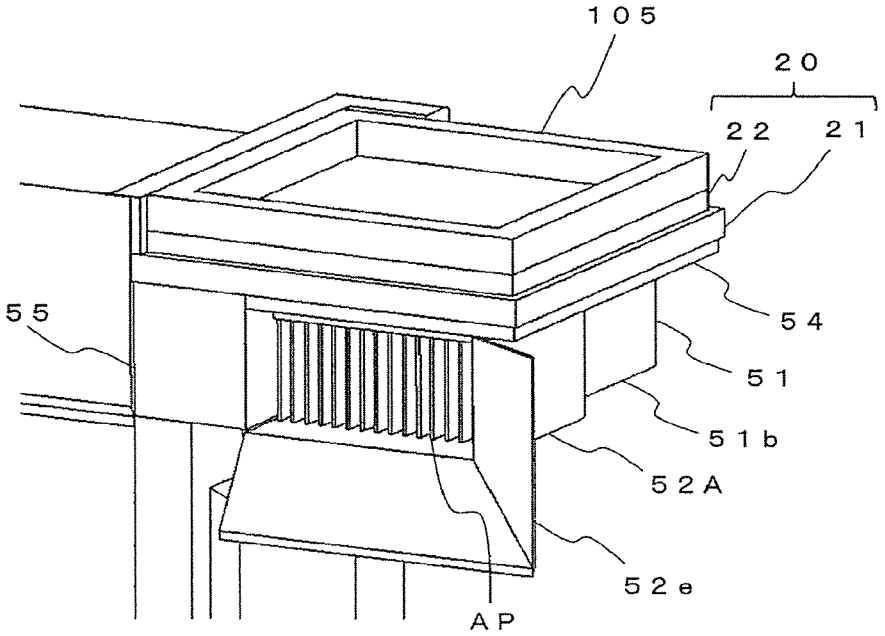
FIG. 13 is a view of a second modification example of the cooling structure according to the second embodiment of the present invention as viewed from the same position as that of FIG. 10.
Figure 14:
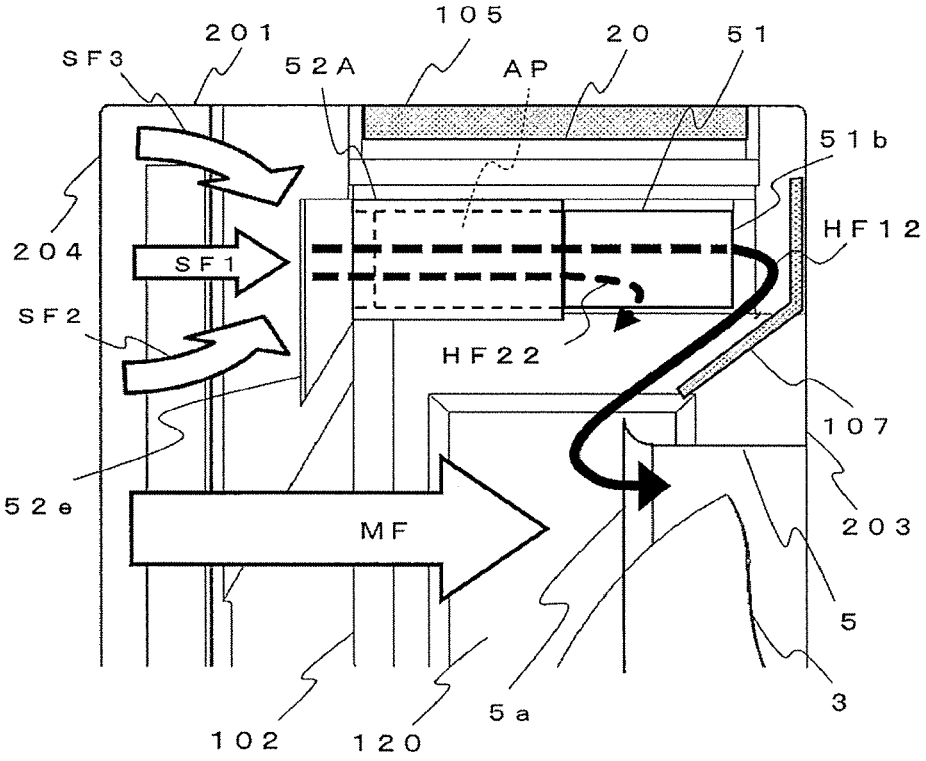
FIG. 14 is a view of a second modification example of the cooling structure according to the second embodiment of the present invention as viewed from the same position as that of FIG. 12.

Further, as in the second modification example illustrated in FIG. 13 and FIG. 14, a foamed resin member 105 may be arranged on the electric component box 20 located on the fan chamber 120 side as a blocking member for blocking the air flow UF.

As illustrated in FIG. 13, the foamed resin member 105 is attached to the upper surface of the lid 22 of the electric component box 20 along the outer periphery of the lid 22. As illustrated in FIG. 14, the foamed resin member 105 is pressed to be compressed by the top panel 201. Accordingly, the gap between the electric component box 20 in the fan chamber 120 and the top panel 201 is blocked by the foamed resin member 105 without any gap.

The subsidiary flow SF3 is prevented from flowing into the gap between the electric component box 20 and the top panel 201, and flows toward the duct 52A. With this, the flow rate of the air flow introduced into the air flow passages AP is increased. As a result, the heat radiation effect of the heat sink 51 is further improved.

The blocking member is not limited to the foamed resin member 105, but may be any member as long as the member can close the gap between the electric component box 20 and the top panel 201.

Further, in FIG. 13, the foamed resin member 105 is mounted along four sides of the upper surface of the lid 22. However, the arrangement of the foamed resin member 105 is not limited thereto. For example, the foamed resin member 105 may be attached to the entire upper surface of the lid 22, or may be mounted to only the side of the upper surface of the lid 22 on the back side of the outdoor unit 100 and both sides on side surface sides.

The first and second embodiments of the present invention have been described, and the present invention is not limited to those embodiments. It is apparent to those skilled in the art that variations and modifications may be made to those embodiments without departing from the scope of the present invention. The scope of the present invention is defined by the appended claims and their equivalents.

REFERENCE SIGNS LIST

3 air-sending fan, 5 bellmouth, 5*a* annular protruding portion, 7 compressor, 71 anti-vibration rubber, 8 reactor, 20 electric component box, 21 cover, 22 lid, 30 electric circuit board, 33 power supply control component (heat generator), 50, 50A cooling structure, 51 heat sink, 51*a* heat sink base plate, 51*b* heat-radiating fins, 52,52A duct, 52*b* downstream end portion, 52*e* extending portion, 54 heat sink holder, 55 heat sink support, 81 core, 82 coil, 100,100A outdoor unit, 102 partition plate, 103 heat exchanger, 104 support plate, 105 foamed resin member, 107 baffle plate, 110 machine chamber, 120 fan chamber, 200 casing, 201 top panel, 202 bottom panel, 203 front panel, 204 back panel, 205,206 side panel.

The invention claimed is:

1. An outdoor unit, comprising:

a cooling structure comprising:

a heat sink to be mounted to a heat generator; and a duct, which is mounted to the heat sink, and is configured to guide an air flow flowing around the heat sink to the heat sink, and a heat exchange, wherein the heat sink includes a plurality of heat-radiating fins arranged at an interval, wherein the heat sink has an air flow passage to allow the air flow to pass through the air flow passage, wherein the duct has a downstream end portion of the duct and an upstream end portion of the duct that is closer to the heat exchange than the downstream end portion of the duct, wherein the downstream end portion of the duct is to be mounted to an upstream side of a downstream end portion of the heat sink, and wherein the upstream end portion of the duct is to be extended to an upstream side of the air flow beyond an upstream end portion of the heat sink so as to surround a periphery of the upstream end portion of the heat sink, wherein the cooling structure further comprising:

a casing in which the heat generator, the heat sink, and the duct are accommodated; and an air-sending fan configured to generate the air flow, wherein the casing has an inlet port and an exhaust port, wherein a peripheral edge portion of the exhaust port includes an annular protruding portion that protrudes to an inner side of the casing wherein the annular protruding portion has a downstream end portion of the annular protruding portion and an upstream end portion of the annular protruding portion that is located closer to the heat exchange than the downstream end portion of the annular protruding portion, wherein the downstream end portion of the duct is located upstream of the air flow than the upstream end portion of the annular protruding portion, wherein the upstream end portion of the annular protruding portion is provided between the downstream end portion of the duct and the downstream end portion of the heat sink, wherein the downstream end portion of the duct is located farther from the heat exchange than the upstream end portion of the duct, and wherein the downstream end portion of the heat sink is located farther from the heat exchange than the upstream end portion of the heat sink.

2. The outdoor unit according to claim 1, wherein the downstream end portion of the duct is configured to cover an outer periphery of the air flow passage from the upstream end portion of the air flow passage to a middle position of the air flow passage.

3. The outdoor unit according to claim 1, wherein at least one surface of surfaces of the duct that form the another end side is extended to the upstream side of the air flow with respect to another surface of the surfaces of the duct that form the another end side.

4. The outdoor unit according to claim 3, wherein the extended surface comprises two surfaces forming a corner portion of the duct, and the two surfaces are extended from two sides forming a cross section of the air flow passage.

5. The outdoor unit according to claim 3, wherein the upstream end portion of the duct is extended in a direction of expanding outward as being spaced away from an upstream end portion of the air flow passage.

6. The outdoor unit according to claim 5, wherein the extended surface is expanded outward from the upstream end portion of the air flow passage at an inclination of 45°.

7. The outdoor unit according to claim 1, wherein the end portion of the downstream end portion of the duct is located on an upper side with respect to an uppermost portion of the end portion of the protruding portion.

8. The outdoor unit according to claim 1, the cooling structure further comprising a baffle plate configured to guide an air flow flowing out from the air flow passage toward the exhaust port, wherein the baffle plate is mounted to an inner wall of the casing that faces a downstream end portion of the air flow passage.

9. The outdoor unit according to claim 1, comprising:

a partition plate configured to partition the casing into a machine chamber in which a compressor and other components are arranged and a fan chamber in which the air-sending fan is arranged;

an electric component box in which an electric circuit board is to be accommodated; and a blocking member configured to block an air flow, wherein the electric component box is arranged across the machine chamber and the fan chamber above the partition plate, wherein, in a region of the electric circuit board to be accommodated in the electric component box on the fan chamber side, an electronic component serving as the heat generator is mounted, wherein the heat sink is mounted to the electronic component, and wherein the blocking member is arranged between an upper portion of the electric component box and an inner wall of the top panel forming a top surface of the casing.

10. The outdoor unit according to claim 1, wherein the plurality of heat-radiating fins are arranged at given intervals, wherein the air flow passage is formed by a gap defined between the heat-radiating fins adjacent to each other, and wherein a length of extending the upstream end portion of the duct to the upstream side with respect to the upstream end portion of the air flow passage is larger than the interval.

11. The outdoor unit according to claim 1, wherein the air flow passage is one or more gaps formed by the adjacent heat-radiating fins among the plurality of heat-radiating fins, wherein an upstream end portion of the air flow passage is an upstream end portion of the heat sink, and wherein the duct faces the heat sink from the downstream end portion of the duct to the upstream end portion of the air flow passage.

12. The outdoor unit according to claim 1, wherein the upstream end portion of the duct has an extending portion, and wherein the extending portion extends outward from the upstream end portion of the duct so as to spread both laterally and downwardly.

13. The outdoor unit according to claim 1, wherein the upstream end portion of the duct has an extending portion, wherein a downstream end portion of the extending portion is connected to the upstream end portion of the duct, and wherein an upstream end portion of the extending portion does not contact the heat exchange.

14. The outdoor unit according to claim 1, wherein the upstream end portion of the duct is to be extended horizontally to an upstream side of the air flow beyond an upstream end portion of the heat sink by a length larger than the interval at which the heat-radiating fins are arranged so as to surround a periphery of the upstream end portion of the heat sink.

15. The outdoor unit according to claim 1, wherein the heat sink has a downstream end portion of the heat sink and an upstream end portion of the heat sink that is closer to the heat exchange than the downstream end portion of the heat sink.

* * * * *